United States Patent [19]

Aozuka et al.

[11] 4,053,807

[45] Oct. 11, 1977

[54] THERMIONIC CATHODE AND HEATER STRUCTURE ON CERAMIC BASE PLATE

[75] Inventors: Torao Aozuka, Chofu; Akio Ohkoshi; Shoichi Muramoto, both of Tokyo; Akira Nakayama, Fuchu; Koichiro Sumi, Inagi, all of Japan

[73] Assignee: Sony Corporation, Tokyo, Japan

[21] Appl. No.: 672,501

[22] Filed: Mar. 31, 1976

[30] Foreign Application Priority Data

Apr. 3, 1975 Japan ..... 50-40590

[51] Int. Cl.[2] ..... H01J 29/50; H01J 29/46; H01J 19/18

[52] U.S. Cl. ..... 313/409; 313/340; 313/446

[58] Field of Search ..... 313/446, 340, 409, 345, 313/411

[56] References Cited

U.S. PATENT DOCUMENTS

| | | | |
|---|---|---|---|
| 3,096,211 | 7/1963 | Davis | 313/345 X |
| 3,745,403 | 7/1973 | Misumi | 313/345 X |
| 3,748,522 | 7/1973 | Geppert | 313/340 |

*Primary Examiner*—Robert Segal
*Attorney, Agent, or Firm*—Lewis H. Eslinger; Alvin Sinderbrand

[57] ABSTRACT

A thermionic cathode structure includes a ceramic base plate, a heater layer of tungsten coated on the ceramic base plate, a cathode lead layer of tungsten formed on a ceramic insulating layer covering the heater layer, a base metal layer coated on the cathode lead layer, and a cathode material coated on the base metal layer.

10 Claims, 3 Drawing Figures

THERMIONIC CATHODE AND HEATER STRUCTURE ON CERAMIC BASE PLATE

BACKGROUND OF THE INVENTION

1. Field of the Invention

The present invention relates generally to a thermionic cathode, and is directed more particularly to a thermionic cathode suitable for use with an electronic tube such as a color cathode ray tube and so on.

2. Description of the Prior Art

In the prior art, an indirectly heated thermionic cathode has usually been employed as the cathode of a color cathode ray tube, for example, as shown in FIG. 1, the cathode used in a color cathode ray tube of the Trinitron (Trade Mark) type or three-beam single gun type is formed of three cathode sleeves 3R, 3G and 3B each of which has a heater 2 therein and which are aligned in the horizontal direction within a cup-shaped first grid $G_1$ common to the three cathode sleeves 3R, 3G and 3B. The cathode sleeves 3R, 3G and 3B are covered, at their ends facing an end plate 5 of the grid $G_1$, with caps 4 which will serve as the base metal of the cathode, and a cathode material $4_1$ is coated on the top surface of each of the caps 4 to form a respective thermionic emission face. The cathode sleeves 3R, 3G and 3B pass through apertures or bores 7R, 7G and 7B formed in a ceramic base plate 6, which is inserted in the grid $G_1$ and their thermionic emission faces are positioned to oppose three apertures 8R, 8G and 8B, respectively formed through the end plate 5 of the grid $G_1$. The cathode sleeves 3R, 3G and 3B are fixedly supported by supporting pins (not shown) planted on the base plate 6 through supporting tabs (not shown), respectively, and the heaters 2 are supported in such a manner that the ends of each heater 2 are welded to the corresponding pair of heater rests (not shown) formed on the base plate 6. The base plate 6, which supports the cathode sleeves 3R, 3G and 3B and the respective heaters 2, is disposed in the grid $G_1$ and spaced from the end plate 5 of the grid $G_1$ through a spacer 9 and is fixed in the grid $G_1$ by a retainer 10.

Further, in order to avoid the leakage into each other of thermions emitted from the respective cathodes, which leakage would cause crosstalk, a pair of shield plates or a cylindrical shield plate 1 are attached to the inner surface of the end plate 5 to isolate the thermion emitting portions of the respective cathode sleeves 3R, 3G and 3B.

As described above, the prior art indirectly heated type thermionic cathode is formed of a number of parts so that it is trouble-some to assemble the parts. Especially, in the case of a color cathode ray tube in which a plurality of electron beams are necessary or a plurality of cathodes are used, its productivity is much lowered thereby.

In order to avoid the defects of the above prior art cathode, a cathode formed of a laminated structure has been proposed for manufacture by a so-called thick-film print-circuit technique in which a heater and a cathode are successively coated on a base plate. However, the prior art cathode laminated structure is lacking in reliability.

SUMMARY OF THE INVENTION

It is an object of the present invention to provide an improved thermionic cathode free from the defects of the prior art cathode.

It is a further object of the invention to provide a thermionic cathode formed of a laminated structure and which has improved reliability.

According to an aspect of the present invention, there is provided a thermionic cathode which comprises a ceramic base plate, a heater layer consisting of tungsten and which is coated on the ceramic base layer, a ceramic insulating layer coated on the ceramic base plate and covering the heater layer, a cathode lead layer consisting of tungsten and coated on the ceramic insulating layer, a base metal layer coated on the cathode lead layer and a cathode material coated on the base metal layer.

The above and other objects, features and advantages of the present invention, will become apparent from the following description taken in conjunction with the accompanying drawings.

DESCRIPTION OF THE PREFERRED EMBODIMENT

Figure 1:
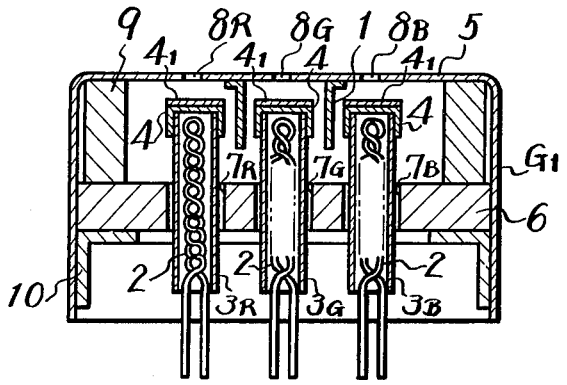
Fig. 1 PRIOR ART
FIG. 1 is an enlarged cross-sectional view of a previously described prior art cathode.
Figure 2:
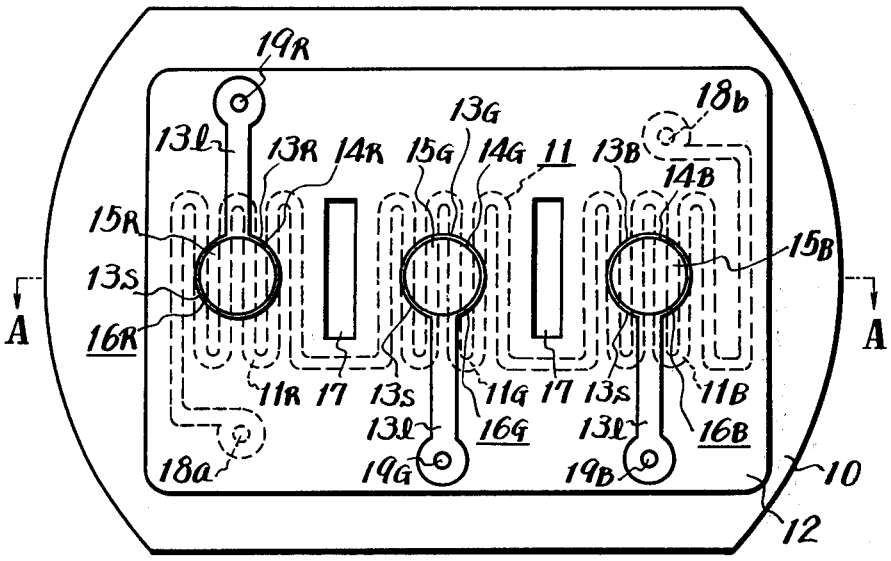
FIG. 2 is an enlarged plan view of a cathode according to an embodiment of the present invention.
Figure 3:
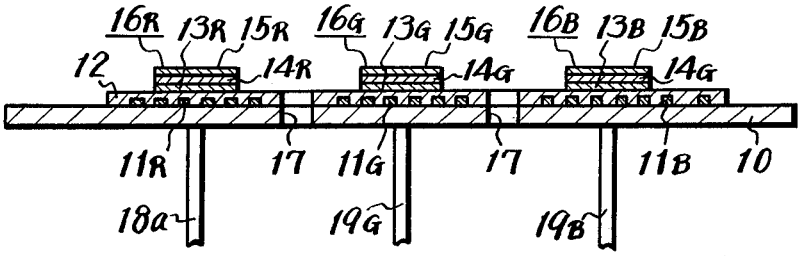
FIG. 3 is a cross-sectional view taken along the line A—A in FIG. 2.

Referring to FIGS. 2 and 3 in detail, it will be seen that the thermionic cathode device there illustrated is adopted for producing three electron beams so as to be useful in a color cathode ray tube of the Trinitron (Trade Mark) type. The illustrated cathode device includes a base plate 10 made of ceramic, for example, alumina, on which there is coated a heat generating layer or heater layer 11 in the shape of a strip made of tungsten. The stripshaped heater layer 11 is coated on the ceramic base plate 10 in a serpentine pattern (FIG. 2) and will produce a Jouleheat when a current flows therethrough. In the embodiment illustrated on FIG. 2, the serpentine heater layer 11 is so coated on the ceramic base plate 10 that the density of the heater layer 11 is high on, for example, three portions 11R, 11G and 11B of the base plate 10. Therefore, when the heater layer 11 is supplied with a current, the three portions 11R, 11G and 11B are locally heated to a high temperature as compared with the other portions of the base plate 10. In the illustrated embodiment, only one heater layer 11 of strip-shape is used to form the densely packed portions 11R, 11G and 11B on the base plate 10 and its both ends serve as current supply points or terminals, but it may be possible that the densely packed serpentine portions 11R, 11G and 11B are formed of separate heater layers of strip-shape, with the separate heater layers forming the densely packed serpentine portions 11R, 11G and 11B being connected in parallel with one another, and the ends of the respective heater layers being used as current supply points or terminals. This latter case may be desirable for obtaining uniform heating.

As previously mentioned, the heater layer 11 may be made of tungsten W, but the heater layer 11 can be made of tungsten W to which there is added either one or both of thorium Th and rhenium Re.

An insulating layer 12 made of ceramic, for example, alumina, is coated on the base plate 10 to cover the heater layer 11, and three cathode lead layers 13R, 13G and 13B are coated on the insulating layer 12 at isolated positions. Each of the cathode lead layers 13R, 13G and 13B inludes a disc-shaped plate portion 13S, which is positioned above the respective one of the densely packed serpentine portions 11R, 11G and 11B of the heater layer 11, and a lead portion **13*l* extended from the serpentine disc-shaped plate portion 13S to a side of the insulating layer 12. The cathode lead layers 13R, 13G and 13B** are plated with nickel Ni so as to improve their electric conductivity, if necessary.

On the disc-shaped plate portions 13S of the cathode lead layers 13R, 13G and 13B, there are coated base metal layers 14R, 14G and 14B, respectively, and on the base metal layers 14R, 14G and 14B there are coated cathode materials 15R, 15G and 15B, respectively, to form three cathode member 16R, 16G and 16B which serve as thermion emitting sources, respectively.

Apertures or recesses 17 are formed through or on the ceramic insulating layer 12 and base plate 10 between the cathode members 16R and 16G and between the cathode members 16G and 16B, respectively. The apertures or recesses 17 will be used for planting thereon shield members (not shown) which serve to avoid cross-talks between thermions emitted from the respective cathode members 16R, 16G and 16B.

Terminal pins **18*a* and 18*b* are planted on the ceramic base plate 10 in electrical contact with respective ends of the strip-shaped heater layer 11 and will serve as terminals across which a power voltage will be applied to heat the heater layer 11. Also, terminal pins 19R, 19G and 19B are planted on the ceramic base plate 10 in electrical contact with the ends of the lead portions 13*l* of the cathode lead layers 13R, 13G and 13B, respectively, and will serve as terminals through which cathode potential will be applied to the respective cathode members 16R, 16G and 16B**.

In order to manufacture the thermionic cathode of the invention with the construction described above, a raw material used for making the ceramic base plate 10 is first prepared as follows:

The below starting
Alumina ($Al_2O_3$) powder . . . 94 weight %
$SiO_2$ . . . 4.5 inches
MgO . . . 0.9 inches
CaO . . . 0.6 inches are mixed with an organic solvent and binder to provide paste therefrom, and then this paste is molded as a sheet by extrusion between rolls or by casting. On the non-sintered or so-called green sheet of alumina ceramic thus obtained, the heater layer 11 is formed by the printing method with the predetermined pattern described previously.

Informing the heater layer 11 on the ceramic base plate 10, powders of tungsten W and thorium Th or rhenium Re are mixed with a binder, such as water glass or the like, to form a printing paste and then this paste is coated on the ceramic base plate 10 by the screen printing method.

On the non-sintered ceramic base plate 10 having coated thereon the heater layer 11, a paste prepared by mixing alumina powders with a binder is printed to form a non-sintered or so-called green ceramic insulating layer 12.

Then, a paste, whose composition is similar to that of the paste used to form the heater layer 11, is printed on the non-sintered ceramic insulating layer 12 to form the respective cathode lead layers 13R, 13G and 13B thereon.

Apertures or bores are formed through the non-sintered ceramic base plate 10 and the non-sintered ceramic insulating layer 12 at the positions where the terminal pins **18*a*, 18*b*, 19R, 19G and 19B** are to be planted.

Then, the non-sintered ceramic base plate 10 and the non-sintered ceramic insulating layer 12 are subjected to the sintering treatment and thereafter the organic binders contained in the respective part are removed or evaporated away.

Thereafter, if necessary, the respective cathode lead layers 13R, 13G and 13B are plated with nickel Ni. Then, the base metal layers 14R, 14G and 14B are formed thereon, respectively. The base metal layers 14R, 14G and 14B may be formed by, for example, preparing a thin layer made of Ni with a reduction agent, such as tungsten W, magnesium Mg or the like, added thereto, and then coating the prepared thin layer on the cathode lead layers 13R, 13G and 13B with gold Au or directly coating the thin layer on the cathode lead layers 13R, 13G and 13B by printing, or by the vaporization method or the like.

Then, a paste consisting of the carbonates of barium Ba, strontium Sr and calcium Ca, a binder and a solvent is screen-printed or blown on the respective base metal layers 14R, 14G and 14B to form thereon the cathode materials 15R, 15G and 15B, respectively.

Thereafter, the structure is subjected to a suitable heat treatment to remove unnecessary binder, solvent and the like contained in the base metal layers 14R, 14G and 14B and in the cathode materials 15R, 15G and 15B, respectively, and also to produce the oxides of the barium Ba, strontium Sr, calcium Ca and so on in the cathode materials 15R, 15G and 15B, respectively.

The terminal pins **18*a*, 18*b*, 19R, 19G and 19B are then passed through the apertures formed in the ceramic base plate 10 and ceramic insulating layer 12 and connected by soldering ends of the heater layer 11 and to the ends of the respective lead members 13 *l***.

With the thermionic cathode of the present invention constructed as above, the heater layer 11 formed on the ceramic base plate 10 and covered with the ceramic insulating layer 12 and the cathode lead layers 13R, 13G and 13B are made of tungsten W whose thermal expansion coefficient is approximately the same as that of the alumina ceramic forming the ceramic base plate 10 and the ceramic insulating layer 12, so that theramal distortion of the cathode structure, which may be caused by temperature increase or decrease when the cathode is operated or not operated, can be prevented effectively, and hence the cathode structure is improved in reliability and prolonged in life. Further, in the cathode structure in accordance with the present invention, tungsten W, which acts as a reduction agent for the cathode materials, is used as the material of the respective cathode lead layers 13R, 13G and 13B, so that such tungsten W can act as a reducing agent as well as the base metals in the cathode structure. In other words, during the long use of the cathode structure, a part of the tungsten W in the cathode lead layers 13R, 13G and 13B is diffused into the surface of the cathode structure or the cathode material to assist its reduction and hence to promote its thermionic emission efficiency for a long period of time and also to prolong thermionic emission life of the cathode structure.

In case where the thorium Th and rhenium Re are added to the materials of the heater layer 11 and cathode lead layers 13R, 13G and 13B, respectively, cracking of the respective layers when heated by the heat during the sintering treatment or by heat generated in operation and, consequent changes in the characteristics of the cathode structure, can be avoided. In addition, since the thorium Th and rhenium Re act to reduce the cathode material in a manner similar to the tungsten W, they are diffused into the cathode material and also act to prolong thermionic emission life.

Further, in the cathode structure in accordance with the present invention, the heater layer 11 and the cathode lead layers 13R, 13G and 13B are made of tungsten W, so that it is possible that, after these layers are coated on the non-sintered ceramic base plate 10 and the non-sintering ceramic insulating layer 12, they may be subjected to the sintering treatment. By this sintering treatment, it is ensured that the layers 11, and 13R, 13G and 13B can be adhered to the ceramic plate 10 and to ceramic insulating layer 12, respectively, positively and with sufficient intermolecular coupling.

Since the ceramic base plate 10 and the ceramic insulating layer 12 are laminated, the mechanical strength of the whole cathode structure can be greatly increased as compared with that of the prior art.

Further, since the cathode structure according to the present invention is made in the form of a thick laminated layer construction as mentioned above, a number of cathode portions as well as the above described three cathode portions can be manufactured at the same time and hence the present invention makes it possibe to massproduce the same and accordingly the cost thereof can be greatly reduced.

Although the invention has been described above as applied to forming a cathode structure having the three cathode members 16R, 16G and 16B for use with a three-beam type electron gun, it will be apparent that the present invention can also be employed for making any other members of cathode members or a single cathode member.

It will be apparent that many modifications and variations could be effected by one skilled in the art without departing from the spirit or scope as defined in the appended claims of the present invention.

We claim as our invention:

1. A thermionic cathode structure, comprising:

a. a ceramic base plate;

b. a heater layer of tungsten coated on a predetermined area of said ceramic base plate;

c. a ceramic insulating layer coated on said ceramic base plate and covering said heater layer;

d. a cathode lead layer of tungsten coated on a portion of said ceramic insulating layer superposed over said area of the ceramic base plate;

e. a base metal layer coated on said cathode lead layer; and f. a cathode material coated on said base metal layer, said heater layer, ceramic insulating layer, cathode lead layer, base metal layer and cathode material forming a cathode member.

2. A thermionic cathode structure as in claim 1, in which said heater layer and cathode lead layer each further include a material selected from the group consisting of thorium and rhenium.

3. A thermionic cathode structure as in claim 1, in which said ceramic base plate and ceramic insulating layer are each made of alumina ceramic.

4. A therminoic cathode structure as in claim 1, in which said base metal layer consists of nickel to which a small amount of a reduction agent is added.

5. A thermionic cathode structure as in claim 4, in which said reduction agent is selected from the group consisting of tungsten and magnesium.

6. A thermionic cathode structure as in claim 1, in which said cathode material consists of at least one material selected from the group consisting of barium oxide, strontium oxide and calcium oxide.

7. A thermionic cathode structure as in claim 1, in which said cathode lead layer includes a disc portion and a lead portion extended therefrom, and said base metal layer is disposed on said disc portion.

8. A thermionic cathode structure as in claim 1, in which a plurality of said cathode members are formed on said ceramic base plate.

9. A thermionic cathode structure as in claim 8, in which said cathode lead layer of each of said plurality of cathode members includes a disc portion and a lead portion extended therefrom to be supplied with a respective signal voltage.

10. A thermionic cathode structure as in claim 8, in which said cathode lead layers of said plurality of cathode members are electrically separated from each other by said ceramic insulating layer.

* * * * *